US009303385B2

(12) United States Patent
Whipple

(10) Patent No.: US 9,303,385 B2
(45) Date of Patent: Apr. 5, 2016

(54) ADJUSTABLE CLAMP AND METHOD OF USE

(71) Applicant: THE TORO COMPANY, Bloomington, MN (US)

(72) Inventor: William Whipple, Niagara, WI (US)

(73) Assignee: THE TORO COMPANY, Bloomington, MN (US)

( * ) Notice: Subject to any disclaimer, the term of this patent is extended or adjusted under 35 U.S.C. 154(b) by 0 days.

(21) Appl. No.: 14/219,918

(22) Filed: Mar. 19, 2014

(65) Prior Publication Data

US 2015/0267377 A1 Sep. 24, 2015

(51) Int. Cl.
*E01H 5/06* (2006.01)
*E02F 3/96* (2006.01)

(52) U.S. Cl.
CPC ..... *E02F 3/962* (2013.01); *E01H 5/061* (2013.01); *Y10T 29/49874* (2015.01); *Y10T 403/7064* (2015.01)

(58) Field of Classification Search
CPC ..... B66F 3/36; B66F 9/12; E01H 5/04; E01H 5/06; E02F 3/962; E02F 3/96; E02F 3/04; E02F 3/40; E02F 3/401; E02F 3/8152; E02F 3/815; Y10T 29/49874; Y10T 403/7064
USPC ..... 37/466, 468, 403–409, 231, 232; 172/811–817; 414/723, 724
See application file for complete search history.

(56) References Cited

U.S. PATENT DOCUMENTS 2,584,955 A * 2/1952 Williams ..... 248/643
4,189,854 A * 2/1980 Haynes ..... 37/404
4,329,103 A 5/1982 Miller
4,597,205 A 7/1986 Guest
4,819,349 A * 4/1989 Mensch ..... 37/407
5,176,350 A * 1/1993 McQuistian ..... 248/231.51
5,918,389 A * 7/1999 Hall ..... 37/407
6,022,184 A 2/2000 Friedland
6,493,967 B2 * 12/2002 Holmes et al. ..... 37/468

OTHER PUBLICATIONS savikusa.com, "Savik ERG." Retrieved from the Internet on Mar. 19, 2014: http://savikusa.com/Products/ERG.aspx (publicly available prior to Mar. 19, 2014).

avalancheplow.com, "Avalanche, You Never Regret Buying Quality," (2012). Retrieved from the Internet on Mar. 19, 2014: http://www.avalancheplow.com/productCategories/view/1/snow-pushers (publicly available prior to Mar. 19, 2014).

silverlakefabrication.com, "Tractor Snow Plows." Retrieved from the Internet on Mar. 19, 2014: http://www.silverlakefabrication.com/tractorplowssubpage.html (publicly available prior to Mar. 19, 2014).

* cited by examiner

*Primary Examiner* — Robert Pezzuto
(74) *Attorney, Agent, or Firm* — Marshall, Gerstein & Borun LLP

(57) ABSTRACT

An adjustable clamp for mounting an auxiliary tool onto a loader bucket is provided. The adjustable clamp includes a first clamping member possessing a first clamping surface and a second clamping member possessing a second clamping surface. The second clamping member is slidably connected to the first clamping member such that the second clamping surface is movable along an angled path toward the first clamping surface to clamp the loader bucket between the first and second clamping surfaces. Also provided is a snow plow assembly including a snow plow and an adjustable clamp. A method of mounting a snow plow onto a loader bucket by way of an adjustable clamp is also provided.

15 Claims, 5 Drawing Sheets

ADJUSTABLE CLAMP AND METHOD OF USE

FIELD OF DISCLOSURE

This disclosure relates generally to adjustable clamps, and more particularly, to adjustable clamps for mounting a snow plow onto a loader bucket.

BACKGROUND

Loading machines such as tractors and backhoes generally include a loader bucket designed to perform a primary loading task. The loader bucket can be adapted to perform an auxiliary loading task by outfitting the loading bucket with an auxiliary tool. A snow plow is an example of an auxiliary tool that can be mounted onto a loader bucket to make the loader bucket better suited for snow removal.

Clamps are commonly used to attach an auxiliary tool to a loader bucket. One known clamp possesses a first arm and second arm spaced apart by a fixed distance. A lip of the loader bucket is positioned in the gap between the first and second arms. The gap is much wider than the bucket lip to facilitate alignment of the bucket lip between the first and second arms. The relatively large size of the gap, however, results in a loose connection between the clamp and the bucket lip.

Another known clamp employs a threaded fastener to secure the loader bucket between the first and second arms. The threaded fastener passes through a hole in one of the arms and is tightened against the bucket lip. While the threaded fastener helps decrease the looseness of the connection between the clamp and the loader bucket, the threaded fastener is not very durable because of its thread, and the threaded fastener provides a limited amount of clamping force. Additionally, screwing and unscrewing the threaded fastener is time-consuming for an operator.

SUMMARY

Disclosed herein is an adjustable clamp for mounting an auxiliary tool onto a loader bucket. The adjustable clamp includes a first clamping member possessing a first clamping surface and a second clamping member possessing a second clamping surface. The second clamping surface faces the first clamping surface. The second clamping member is slidably connected to the first clamping member such that the second clamping surface is movable along an angled path toward the first clamping surface to clamp the loader bucket between the first and second clamping surfaces.

Also disclosed is a snow plow assembly including a snow plow, a first adjustable clamp and a second adjustable clamp. The first adjustable clamp includes a first clamping member and a second clamping member. The first clamping member of the first adjustable clamp is connected to the snow plow and possesses a first clamping surface. The second clamping member of the first adjustable clamp possesses a second clamping surface spaced apart from and facing the first clamping surface. The second clamping member of the first adjustable clamp is slidably connected to the first clamping member of the first adjustable clamp such that a distance separating the first and second clamping surfaces of the first adjustable clamp is adjustable. The second adjustable clamp includes a first clamping member and a second clamping member. The first clamping member of the second adjustable clamp is connected to the snow plow and possesses a first clamping surface. The second clamping member of the second adjustable clamp possesses a second clamping surface spaced apart from and facing the first clamping surface. The second clamping member of the second adjustable clamp is slidably connected to the first clamping member of the second adjustable clamp such that a distance separating the first and second clamping surfaces of the second adjustable clamp is adjustable.

Further disclosed is a method of using an adjustable clamp to mount a snow plow onto a lip of a loader bucket. The adjustable clamp includes a first clamping member slidably connected to a second clamping member. The method includes positioning the lip of the loader bucket between the first and second clamping members, and connecting the second clamping member to the loader bucket with a chain or strap. The method includes tightening the chain or strap to cause the second clamping member to move toward the first clamping member and thereby clamp the lip of the loader bucket between the first and second clamping members.

DETAILED DESCRIPTION

Figure 1:
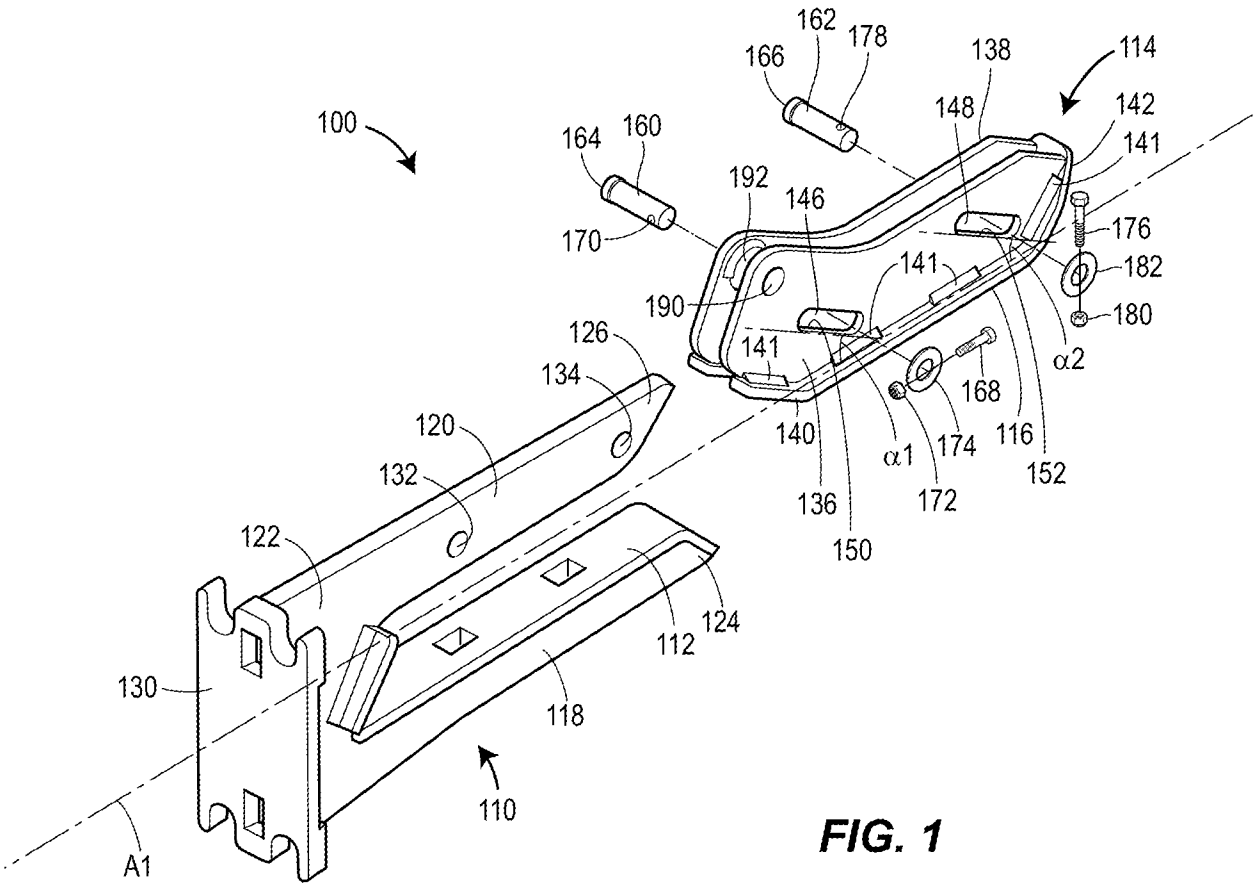
FIG. 1 is a perspective view of an adjustable clamp of the present disclosure prior to assembly.

FIG. 1 illustrates a perspective view of an adjustable clamp 100 prior to assembly. In one embodiment, the adjustable clamp 100 is configured to mount an auxiliary tool, such as a snow plow, onto a loader bucket. The clamp 100 includes a first clamping member 110 possessing a first clamping surface 112 and a second clamping member 114 possessing a second clamping surface 116. The first and second clamping surfaces 112 and 114 are spaced apart and face each other. The second clamping member 114 is slidably connected to the first clamping member 110. So configured, the first and second clamping surfaces 112 and 116 can be pressed against opposite sides of the loader bucket and thereby provide a secure connection between the adjustable clamp 100 and the loader bucket.

Each of the foregoing components of the adjustable clamp 100, and methods of operating the adjustable clamp 100, will now be described in more detail.

As illustrated in FIG. 1, the first clamping member 110 may include a first leg portion 118 and a second leg portion 120 which extend adjacent to each other along a longitudinal axis A1 of the clamp 100. The first and second leg portions 118 and 120 extend from a base portion 122 of the first clamping member 100 and terminate at respective free ends 124 and 126. The first leg portion 118, the second leg portion 120 and the base portion 122 form a U-shape having an open end adjacent the free ends 124 and 126 and a closed end adjacent the base portion 122. The open end of the U-shape is arranged at a rear end of the adjustable clamp 100. The free end 124 may be shaped like a ramp to facilitate the insertion of the loader bucket. The first leg portion 118, the second leg portion 120 and the base portion 122 may be formed as single, unitary structure as shown in FIG. 1, or they can be formed as separate components which are welded (or otherwise secured) together.

The first clamping surface 112 is formed by the surface of the first leg portion 118 that faces the second leg portion 120. The first leg portion 118 may include a wear resistant pad that forms the first clamping surface 112. The first clamping surface 112 may have a roughened and/or textured finish, such as a tread pattern, to increase friction between the first clamping surface 112 and the loader bucket. While the first clamping surface 112 illustrated in FIG. 1 is a planar surface extending parallel to the longitudinal axis A1, in other embodiments the first clamping surface 112 may be curved and/or possess a plurality of ridges and valleys.

The first clamping member 110 is connectable to an auxiliary tool such as a snow plow. A connector plate 130 is provided for this purpose. In one embodiment, screws or bolts are employed to fasten the connector plate 130 to the snow plow such that the first clamping member 110 is removably attached to the snow plow. The connector plate 130 is positioned at a front end of the adjustable clamp 100.

A first hole 132 and a second hole 134 are formed in the second leg portion 120 of the first clamping member 110. Each of the first and second holes 132 and 134 extends through the second leg portion 120 so that opposite ends of each hole open to opposite sides of the second leg portion 120. As described further below, each of the first and second holes 132 and 134 is configured to receive a pin. The shapes of first and second holes 132 and 134 may correspond to the shapes of their respective pins. In one embodiment, both the holes 132 and 134 and their respective pins possess a circular cross-section. The diameters of the holes 132 and 134 may be substantially same as the diameters of the pins so that the holes 132 and 134 restrain movement of the pins.

The second clamping member 114 includes spaced apart first and second side plates 136 and 138. The distance separating the first and second side plates 136 and 138 is sufficient for the second leg portion 120 of the first clamping member 110 to be inserted between the first and second side plates 136 and 138. When assembled, the first and second side plates 136 and 138 border opposite sides of the second leg portion 120 of the first clamping member 110. In one embodiment, welds 141 connect the first and second side plates 136 and 138 to a base plate 140. The base plate 140 spans the distance separating the first and second side plates 136 and 138. An end 142 of the base plate 140 is positioned adjacent to the free end 126 of the first leg portion 120 when the adjustable clamp 100 is assembled. The end 142 may be ramp-shaped to facilitate the insertion of the loader bucket into the adjustable clamp 100. While the first side plate 136, the second side plate 138 and the base plate 140 are shown as separate components, in some embodiments, the first side plate 136, the second side plate 138 and the base plate 140 are formed in one-piece as a single, unitary structure.

The second clamping surface 116 is formed by the surface of the base plate 140 opposite to the first and second side plates 136 and 138. The second clamping surface 116 faces the first clamping surface 112 when the adjustable clamp 100 is assembled. The base plate 140 may include a wear resistant pad that forms the second clamping surface 114. To increase friction between the second clamping surface 112 and the loader bucket, the second clamping surface 112 may have a roughened and/or textured finish, such as a tread pattern. The second clamping surface 112 illustrated in FIG. 1 is planar and parallel to the longitudinal axis A1. In other embodiments, the second clamping surface 112 may be curved and/or possess a plurality of ridges and valleys.

First and second slots 146 and 148 are formed in the first side plate 136. Each of the first and second slots 146 and 148 extends through the first side plate 136 so that opposite ends of each slot open to opposite sides of the first side plate 136. The first slot 146 includes an inner surface 150 and the second slot 148 includes an inner surface 152. Each of the inner surfaces 150 and 152 is angled relative to the longitudinal axis A1 of the adjustable clamp 100. The inner surface 150 forms an angle $\alpha_1$ with the longitudinal axis A1 of approximately (e.g., ±10%) 20-60 degrees, and for example between 30-50 degrees. The inner surface 152 forms an angle $\alpha_2$ with the longitudinal axis A1 of approximately (e.g., ±10%) 20-60 degrees, and for example between 30-50 degrees. In one embodiment, the angle $\alpha_1$ between the inner surface 150 and the longitudinal axis A1 is equal to the angle $\alpha_2$ between the inner surface 152 and the longitudinal axis A1 so that the inner surface 150 is parallel to the inner surface 152. FIG. 1 shows that the inner surface 150 and the inner surface 152 are both planar. In other embodiments, the inner surface 150 and/or the second inner surface 152 may be curved.

Figure 2:
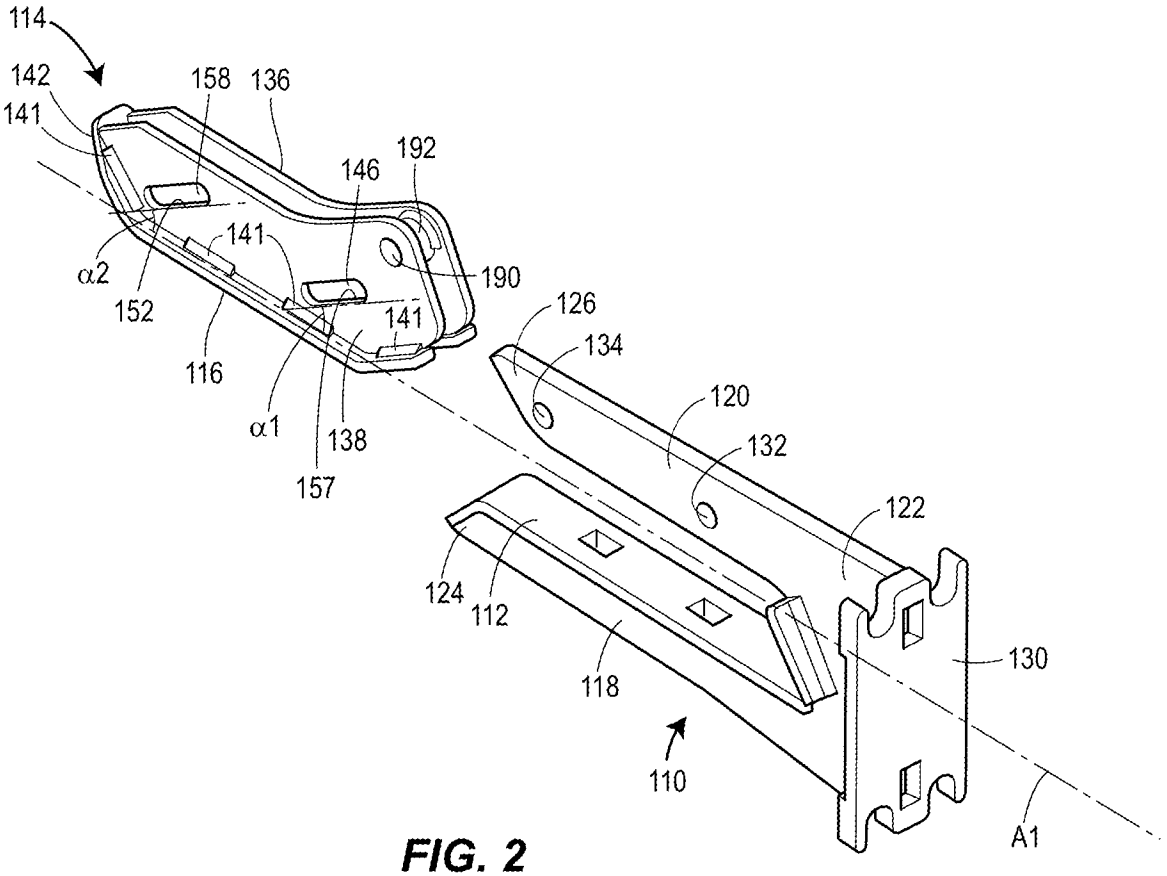
FIG. 2 is a perspective view of the reverse side of the adjustable clamp of FIG. 1.

As illustrated in FIG. 2, first and second slots 156 and 158 are formed in the second side plate 138 and are aligned, respectively, with the first and second slots 146 and 148 formed in the first side plate 136. The first slot 156 includes an inner surface 157 and the second slot 158 includes an inner surface 159. The first slot 156 of the second side plate 138 possesses the same shape, size and orientation as the first slot 146 of the first side plate 136, and the second slot 158 of the second side plate 138 has the same shape, size and orientation as the second slot 148 of the first side plate 136. Accordingly, the angle between the inner surface 157 and the longitudinal axis A1 is equal to the angle $\alpha_1$ between the inner surface 150 and the longitudinal axis A1. Similarly, the angle between the inner surface 159 and the longitudinal axis A1 is equal to the angle $\alpha_2$ between the inner surface 152 and the longitudinal axis A1.

When the adjustable clamp 100 is assembled, the first hole 132 is aligned with the first slot 146 of the first side plate 136 and the first slot 156 of the second side plate 138, and the second hole 134 is aligned with the second slot 148 of the first side plate 136 and the second slot 158 of the second side plate 138. A first pin 160 is inserted through the first slot 146 of the first side plate 136, the first hole 132 and the first slot 156 of the second side plate 138. A second pin 162 is inserted through the second slot 148 of the first side plate 136, the second hole 134 and the second slot 158 of the second side plate 138. The first pin 160 is configured to slide along the inner surface 150 of the first slot 146 and the inner surface 157 of the first slot 156. The second pin 162 is configured to slide along the inner surface 152 of the second slot 148 and the inner surface 159 of the second slot 158. Lubricant may be applied to the inner surfaces of the slots to facilitate the sliding movement of the first and second pins 160, 162. The first and second pins 160 and 162 generally do not move relative to the first clamping member 110 because their movement is constrained by the first and second holes 132 and 134. The first and second pins 160 and 162 may each have a cylindrical shape and may each possess a circular circumferential surface.

A head 164 of the first pin 160 and a head 166 of the second pin 162 abut against the second side plate 138 when the pins are inserted through their respective holes and slots. A fastener 168 may pass through a fastener hole 170 formed in the first pin 160 to restrain axial movement of the first pin 160. A nut 172 secures the fastener 168 to the first pin 160, and a washer 174 protects the first side plate 136 from the fastener 168. Similarly, a fastener 176 may pass through a fastener hole 178 formed in the second pin 162 to resist axial movement of the second pin 162. The fastener 176 is secured to the second pin 162 by way of a nut 180, and a washer 182 protects the first side plate 136 from the fastener 176.

A first tightening member receiving hole 190 is formed in the first side plate 136, and a second tightening member receiving hole 192 is formed in the second side plate 138. In one embodiment, a tightening member, such as a chain or strap, is looped through the holes 190 and 192 to secure the adjustable clamp 100 to a loader bucket. In another embodiment (depicted in FIG. 6 and described in more detail below), one end of the tightening member includes a hook that is hooked around a pin that passes through the holes 190 and 192. The holes 190 and 192 are formed in a raised portion of the first and second side plates 136 and 138 so that tightening the tightening member exerts a rotational torque on the second clamping member 114 that moves the second clamping member 114 towards the first leg portion 118 of the first clamping member 110.

Figure 3:
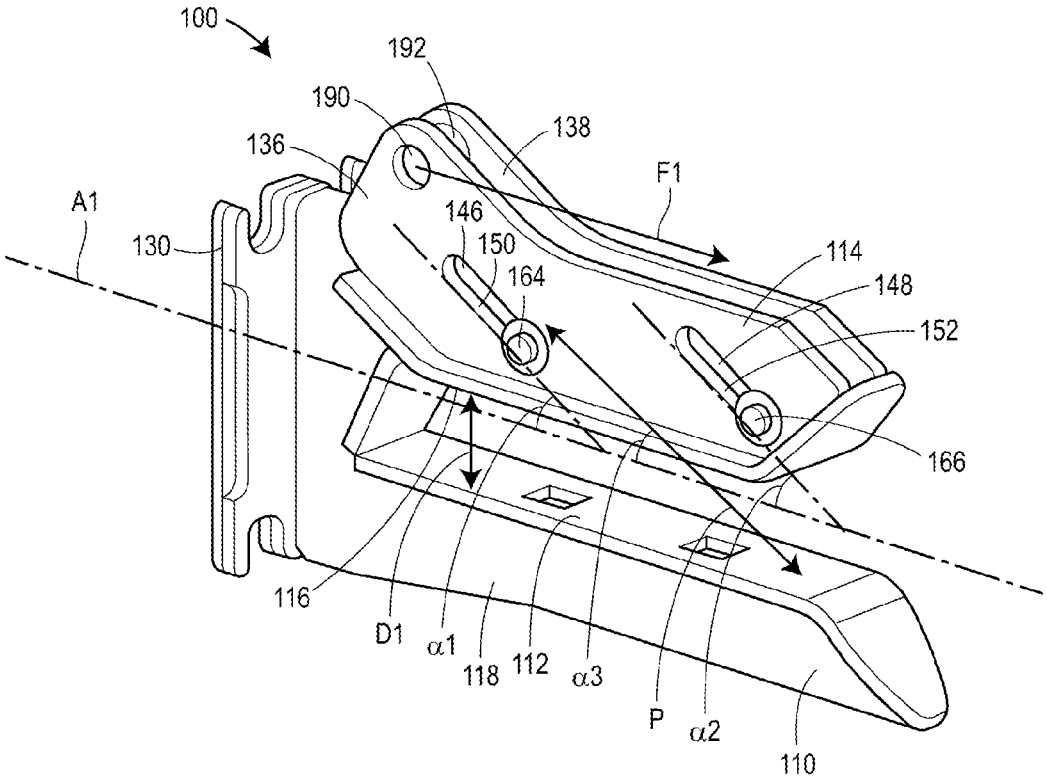
FIG. 3 depicts a perspective view of the adjustable clamp of FIG. 1 in an open position.
Figure 4:
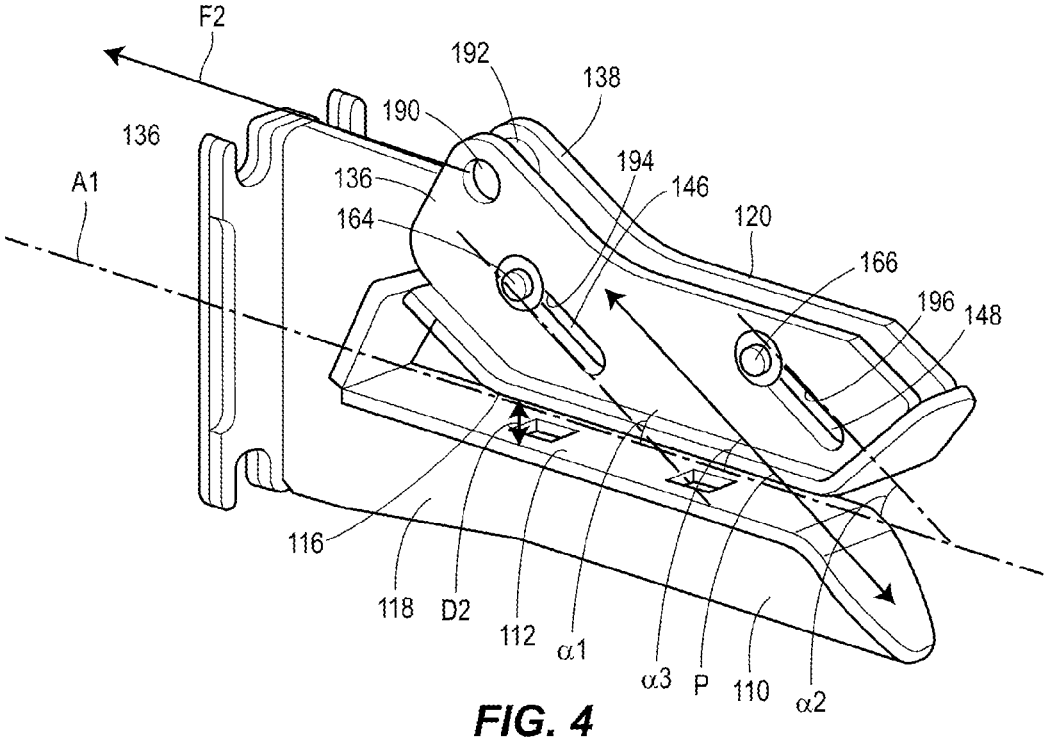
FIG. 4 illustrates a perspective view of the adjustable clamp of FIG. 1 in a closed position.

Turning to FIGS. 3 and 4, the operation of the adjustable clamp 100 will now be described. FIG. 3 illustrates the adjustable clamp 100 in an open position, and FIG. 4 depicts the adjustable clamp 100 in a closed position. A distance D1 separating the first and second clamping surfaces 112 and 116 in the open position is greater than a distance D2 separating the first and second clamping surfaces 112 and 116 in the closed position. In the open position, the pins 160 and 162 are positioned in the lowermost portion of their respective slots. In the closed position, the pins 160 and 162 are positioned in the uppermost portion of their respective slots.

The adjustable clamp 100 is shiftable between the open position and the closed position by moving the second clamping member 114 relative to the first clamping member 110. Arranging the adjustable clamp 100 in the closed position involves moving second clamping member 114 toward the first leg portion 118 of the first clamping member 110, along a linear incline, for example, to decrease the distance separating the first and second clamping surfaces 112 and 116. The second clamping member 114 is guided along an angled path P by the sliding interaction between the pins 160 and 162 and their respective slots 146, 156, 148 and 158. The second clamping surface 116 moves together with the second clamping member 114 along the angled path P. The angled path P forms an angle $\alpha_3$ with the longitudinal axis A1 of the adjustable clamp 100 of approximately (e.g., ±10%) 20-60 degrees, and for example between 30-50 degrees. In one embodiment, the angle $\alpha_3$ of the angled path P is equal to the angle $\alpha_1$ of the inner surface 150 of the first slot 146 and/or the angle $\alpha_2$ of the inner surface 152 of the second slot 148 so that the angled path P is parallel to the inner surface 150 and/or the inner surface 152.

The angled path P illustrated in the drawings is a linear-inclined path. In other embodiments, the angled path P may follow a curve. This can be accomplished by configuring the slots 146, 148, 156 and/or 158 with a curved shape.

FIG. 3 illustrates a force F1 applied to the adjustable clamp 100 to move the adjustable clamp 100 from the open position to the closed position. The force F1 may be provided by tightening a chain or strap passing through the tightening member receiving holes 190 and 192 and connecting the second clamp member 114 to a loader bucket. The force F1 may be applied in a direction substantially parallel to the longitudinal axis A1 of the adjustable clamp 100, or may be a component of a force applied substantially in that direction. The force F1 pushes the inner surface 150 of the first slot 146 against the first pin 160 and pushes the inner surface 152 of the second slot 148 against the second pin 162. Because the inner surfaces 150 and 152 are angled relative to the longitudinal axis A1, the pins 160 and 162 exert a reaction force against the second clamping member 114 that pushes the second clamping member 114 in a downward direction orthogonal to the longitudinal axis A1. The slot-and-pin arrangement thus translates a portion of the force F1, which is substantially parallel to the longitudinal axis A1, into a force that pushes the second clamping member 114 in a downward direction orthogonal to the longitudinal axis A1. As the pins 160 and 162 slide along the inner surfaces 150 and 152 of their respective slots 146 and 148, the second clamping member 114 is guided along the angled path P. Accordingly, the second clamping surface 116 moves along the angled path P toward the first clamping surface 112.

FIG. 4 illustrates a force F2 applied to the adjustable clamp 100 to move the adjustable clamp 100 from the closed position to the open position. The force F2 may be applied by an operator attempting to remove the adjustable clamp 100 from a loader bucket. The force F2 may be substantially parallel to the longitudinal axis A1. An inner surface 194 of the first slot 146, opposite and parallel to the inner surface 150, is pushed against the first pin 160 by the force F2. In a similar manner, an inner surface 196 of the second slot 148, opposite and parallel to the inner surface 152, is pushed against the second pin 162. Due to their angled configuration, the inner surfaces 194 and 196 exert a reaction force against the second clamping member 114 that pushes the second clamping member 114 in an upward direction orthogonal to the longitudinal axis A1. The slot-and-pin arrangement thus translates a portion of the force F2, which is substantially parallel to the longitudinal axis A1, into a force that pushes the second clamping member 114 in an upward direction orthogonal to the longitudinal axis A1. As the pins 160 and 162 slide along the inner surfaces 194 and 196 of their respective slots 146 and 148, the second clamping member 114 is guided along the angled path P. As such, the second clamping surface 116 moves along the angled path P away from the first clamping surface 112.

Figure 5:
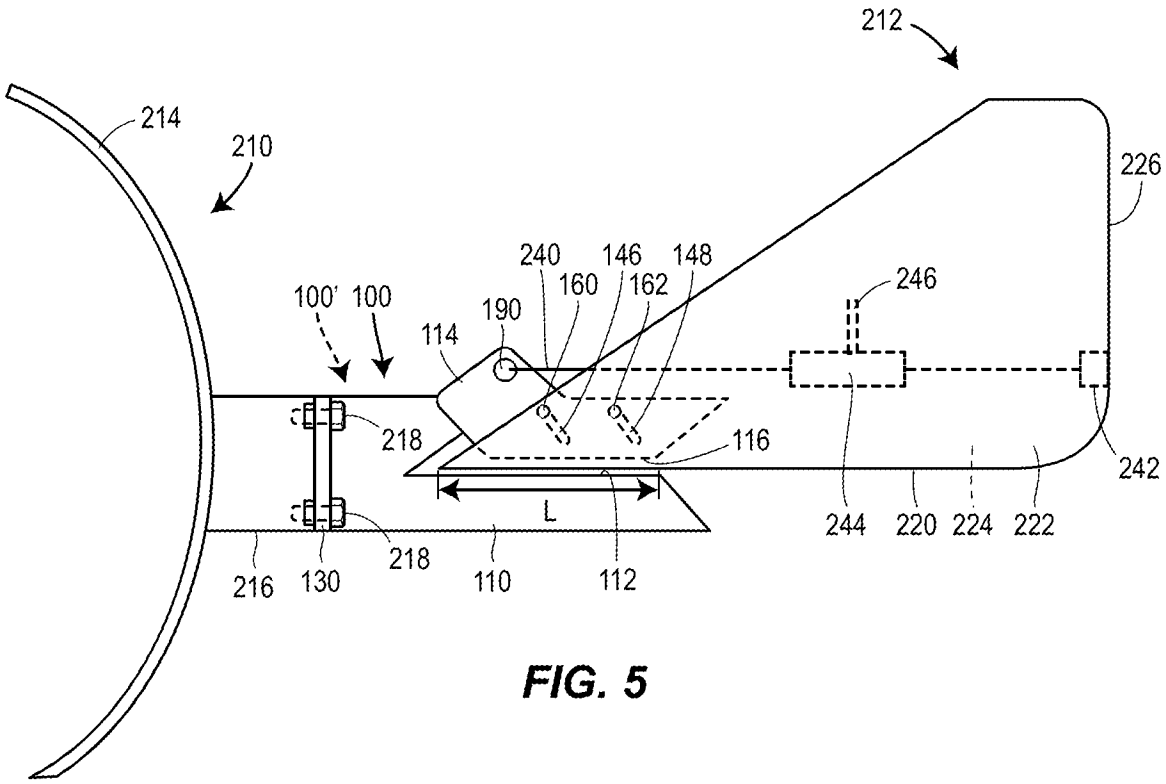
FIG. 5 is a side view of a snow plow mounted onto a loader bucket with two adjustable clamps according to the present disclosure.
Figure 6:
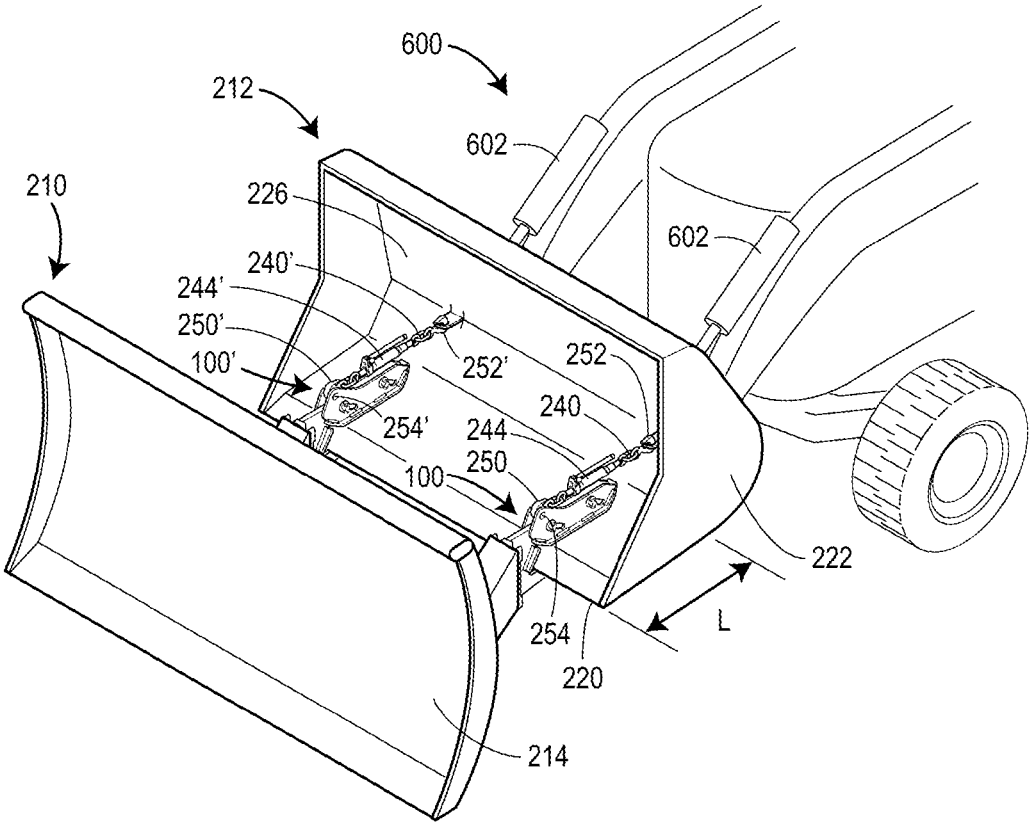
FIG. 6 is a perspective view of a snow plow mounted onto a loader bucket of a tractor with two adjustable clamps according to the present disclosure.

FIGS. 5 and 6 illustrate the use of two adjustable clamps 100 and 100' to mount a snow plow 210 onto a loader bucket 212 of a loader machine 600 such as a tractor, backhoe, wheel loader, etc. The adjustable clamp 100' is hidden from view in FIG. 5 because it is positioned behind the adjustable clamp 100. The adjustable clamp 100' is identical to the adjustable clamp 100. Accordingly, the following description of the adjustable clamp 100 and its connection to the snow plow 210 and the loader bucket 212 applies equally to the adjustable clamp 100'.

The snow plow 212 includes a blade 214 and frame 216 supporting the blade 214. In some embodiments, the frame 216 may be pivotally connected to the blade 214. The frame 216 is removably connected to the connector plate 130 of the connector plate 130 by fasteners 218.

The loader bucket 212 includes a bottom plate 220 that extends between two spaced apart side plates 222 and 224. An upright plate 226, which also spans the distance between the side plates 222 and 224, forms the rear end loader bucket 212. As illustrated in FIG. 6, the upright plate 226 is attached to the hydraulic arms 602 of the loader machine 600. The lip L of the loader bucket 212 is formed by the front end of the bottom plate 220. The lip L of the loader bucket 212 is clamped between the first and second clamping surfaces 112 and 116 of the adjustable clamp 100 to mount the snow plow 210 onto the loader bucket 212. FIG. 5 depicts a small gap between the lip L of the loader bucket 212 and the first and second clamping surfaces 112 and 116. In actuality, the first and second clamping surfaces 112 and 116 would press directly against the lip L of the loader bucket 212.

Clamping the adjustable clamp 100 onto the lip L of the loader bucket 212 involves inserting the lip L of the loader bucket 212 between the first clamping member 110 and the second clamping member 114. This can be accomplished by placing the adjustable clamp 100 on the ground, and subsequently driving the loading machine forward so the lip L of the loader bucket 212 slides between the first and second clamping members 110 and 114. At this point in the process, the adjustable clamp 100 is arranged in the open configuration shown in FIG. 3. Next, a tightening member 240, such as a chain or strap, is looped through the tightening member receiving holes 190 and 192 of the second clamping member 114 as shown in FIG. 5. The tightening member 240 is also looped through a hook or slotted member 242 protruding from the upright plate 226 of the loader bucket 212. A ratchet mechanism 244 (illustrated in dashed lines in FIG. 5) may be arranged along the length of tightening member 240 to tighten the tightening member 240. The ratchet mechanism 244 may possess a handle 246 that allows an operator to use the ratchet mechanism 244 to tighten (i.e., shorten) the tightening member 240.

FIG. 6 illustrates an alternative method of attaching the tightening member 240 to the adjustable clamp 100 and the loader bucket 212. The tightening member 240 illustrated in FIG. 6 includes a first hook 250 and a second hook 252 arranged at opposite ends of the tightening member 240. The first hook 250 is hooked around a pin 254 that passes through the tightening member receiving holes 190 and 192 of the second clamping member 114; and the second hook 252 is hooked around the slotted member 242 protruding from the upright plate 226 of the loader bucket 212. Similar to the FIG. 5 embodiment, the ratchet mechanism 244 is arranged along the length of the tightening member 240 and allows an operator to tighten the tightening member 240.

Once tightened (i.e., shortened), the tightening member 240 pulls the second clamping member 114 toward the upright plate 226 of the loader bucket 212. As described above with reference to FIG. 3, the force F1 exerted by the tightening member 240 causes the second clamping member 114 to move along the angled path P toward the first clamping member 110. The second clamping surface 116 therefore moves downward along the angled path P toward the first clamping surface 112 and clamps the lip L of the loader bucket 212 between the first and second clamping surfaces 112 and 116 as illustrated in FIGS. 5 and 6. After the adjustable clamp 100 has been clamped to the loader bucket 212, the adjustable clamp 100 may be connected to the frame 216 of the snow plow 210 by way of the connector plate 130 and the fasteners 218. As an alternative, the adjustable clamp 100 may be connected to the snow plow 210 prior to clamping the adjustable clamp 100 onto the loader bucket 212.

Removal of the adjustable clamp 100 involves loosening the tightening member 240 and pulling the adjustable clamp 100 off the lip L of the loader bucket 212. This may be done in a manner consistent with the opening operation described above with reference to FIG. 4.

The adjustable clamp of the present disclosure advantageously provides a substantially secure connection between a snow plow, or other auxiliary tool, and a loader bucket. The distance separating the clamping surfaces of the adjustable clamp is adjustable so that the clamp can be securely connected to a variety of different loader buckets having differently-sized lips. Another advantage of the disclosed adjustable clamp is that the distance separating the clamping surfaces can be decreased by tightening a chain or strap that connects the adjustable clamp to a loader bucket. This makes adjusting the adjustable clamp relatively easy for an operator who can tighten the chain or strap relatively quickly with a ratchet mechanism, for example. Additionally, the ability to adjust the clamp with a chain or strap enables the clamp to provide a substantial amount of clamping force.

While the present disclosure has been described with respect to certain embodiments, it will be understood that variations may be made thereto that are still within the scope of the appended claims.

What is claimed is:

1. A snow plow assembly, the snow plow assembly comprising:

a snow plow;

a first adjustable clamp including a first clamping member and a second clamping member, the first clamping member of the first adjustable clamp being connected to the snow plow and possessing a first clamping surface, the second clamping member of the first adjustable clamp possessing a second clamping surface facing the first clamping surface, the second clamping member of the first adjustable clamp being slidably connected to the first clamping member of the first adjustable clamp such that a distance separating the first and second clamping surfaces of the first adjustable clamp is adjustable; and a second adjustable clamp including a third clamping member and a fourth clamping member, the third clamping member of the second adjustable clamp being connected to the snow plow and possessing a third clamping surface, the fourth clamping member of the second adjustable clamp possessing a fourth clamping surface spaced apart from and facing the third clamping surface, the fourth clamping member of the second adjustable clamp being slidably connected to the third clamping member of the second adjustable clamp such that a distance separating the third and fourth clamping surfaces of the second adjustable clamp is adjustable.

2. The snow plow assembly of claim 1, wherein the second clamping surface of the first adjustable clamp is movable toward the first clamping of the first adjustable clamp surface along an angled path.

3. The snow plow assembly of claim 1, comprising:

a first slot formed in the second clamping member of the first adjustable clamp, the first slot including a first inner surface angled relative to a longitudinal axis of the first adjustable clamp;

a first hole formed in the first clamping member of the first adjustable clamp and aligned with the first slot; and a first pin passing through the first hole and the first slot, the first pin being slidable along the first inner surface of the first slot.

4. The snow plow assembly of claim 3, comprising a second slot formed in the second clamping member, the second slot including a second inner surface parallel to the inner surface of the first slot.

5. The snow plow assembly of claim 4, comprising a tightening member receiving hole formed in the second clamping member of the first adjustable clamp.

6. The snow plow assembly of claim 1, wherein the first clamping member of the first adjustable clamp is U-shaped member possessing a first leg portion and a second leg portion, the first leg portion forming the first clamping surface, the second leg portion being bordered on opposite sides by the second clamping member.

7. The snow plow assembly of claim 1, wherein the second clamping member of the first adjustable clamp moves away from the snow plow when the second clamping surface of the first adjustable clamp moves toward the first clamping surface of the first adjustable clamp.

8. The snow plow assembly of claim 3, the first pin being movable relative to the longitudinal axis when the first pin slides along the inner surface of the first slot.

9. The snow plow assembly of claim 1, comprising a first pin extending between the first and the second clamping members, the first pin being configured to move together with the first clamping member when the distance separating the first and second clamping surfaces is decreased.

10. The snow plow assembly of claim 9, the first pin being configured to slide along a surface of the second clamping member toward the second clamping surface when the distance separating the first and second clamping surface is decreased.

11. A method of using an adjustable clamp to mount a snow plow onto a lip of a loader bucket, the adjustable clamp including a first clamping member slidably connected to a second clamping member, the method comprising:

positioning the lip of the loader bucket between the first clamping member and the second clamping member;

connecting the second clamping member to the loader bucket with a chain or strap;

tightening the chain or strap to cause the second clamping member to move toward the first clamping member and thereby clamp the lip of the loader bucket between the first and second clamping members.

12. The method of claim 11, wherein tightening the chain or strap causes the second clamping member to move along an angled path toward the first clamping member.

13. The method of claim 11, the first clamping member being slidably connected to the second clamping member by a pin passing through a hole formed in the first clamping member and a slot formed in the second clamping member.

14. The method of claim 13, the slot possessing an inner surface angled relative to the tightened chain or strap.

15. The method of claim 11, wherein the first clamping member is a U-shaped member possessing a first leg portion and a second leg portion, the first leg portion being bordered on opposite sides by the second clamping member, and the second leg portion being pressed against an underside of the lip of the loader bucket during the tightening of the chain or strap.

* * * * *